US005937250A

United States Patent [19]

Kwak et al.

[11] Patent Number: 5,937,250

[45] Date of Patent: Aug. 10, 1999

[54] DEVELOPMENT APPARATUS WITH CLEANING DEVICE FOR LIQUID ELECTROPHOTOGRAPHIC PRINTER

[75] Inventors: Jin-geun Kwak; Wan-ha Kim; Kee-son Chang, all of Suwon, Rep. of Korea

[73] Assignee: Samsung Electronics Co., Ltd., Kyungki-Do, Rep. of Korea

[21] Appl. No.: 09/119,942

[22] Filed: Jul. 21, 1998

[30] Foreign Application Priority Data

Aug. 26, 1997 [KR] Rep. of Korea ..... 97-41181

[51] Int. Cl.[6] ..... G03G 15/10

[52] U.S. Cl. ..... 399/249

[58] Field of Search ..... 399/249, 239, 399/273, 283; 118/109, 261, 262, 413, 414; 430/117–119

[56] References Cited

U.S. PATENT DOCUMENTS

| | | | |
|---|---|---|---|
| 3,907,423 | 9/1975 | Hayashi et al. | 399/249 |
| 3,978,817 | 9/1976 | Hauser et al. | 399/239 |
| 4,325,627 | 4/1982 | Swidler et al. | 399/249 |
| 5,064,738 | 11/1991 | Rakov et al. | 430/117 |
| 5,805,963 | 9/1998 | Teschendorf et al. | 399/249 |

FOREIGN PATENT DOCUMENTS 3-198084 8/1991 Japan .

*Primary Examiner*—Robert Beatty
*Attorney, Agent, or Firm*—Sughrue, Mion, Zinn, Macpeak & Seas, PLLC

[57] ABSTRACT

A development apparatus for a liquid electrophotographic printer includes a development roller for supplying a developer liquid to a photoreceptor belt on which a latent electrostatic image is formed, a plurality of squeegee rollers for removing excess developer liquid sticking to the photoreceptor belt, at least one cleaning device having a rotary body rotatably installed in proximity with at least one of the plurality of squeegee rollers, and a plurality of blades installed on the perimeter of the rotary body at a predetermined spacing, in contact with the surfaces of the respective squeegee rollers, and a rotation mechanism for selectively bringing one of the plurality of blades into contact with the surface of each squeegee roller. Therefore, when one blade is worn, the worn blade can be replaced with a new one without dismantling the development apparatus, and thus the life of the development apparatus is prolonged.

6 Claims, 5 Drawing Sheets

DEVELOPMENT APPARATUS WITH CLEANING DEVICE FOR LIQUID ELECTROPHOTOGRAPHIC PRINTER

BACKGROUND OF THE INVENTION

1. Field of the Invention

The present invention relates to a liquid electrophotographic printer, and more particularly, to a development apparatus for a liquid electrophotographic printer having a cleaning device for effectively removing a developer liquid sticking to a squeegee roller.

2. Description of the Related Art

An electrophotographic printer employs a developer liquid in which a toner is mixed with a volatile liquid carrier.

Referring to FIG. 1 illustrating an example of a general liquid electrophotographic printer, a photoreceptor belt 110 circulates on an endless track around first, second and third rollers 121, 122 and 123. The first roller 121 is a backup roller for pressing the photoreceptor belt 110 against a transfer roller 124 for transferring a toner image formed on the photoreceptor belt 110 to a recording sheet 126, the second roller 122 is a steering roller for preventing meandering by adjusting the torsion force of the photoreceptor belt 110, and the third roller 123 is a driving roller driven by a driving motor (not shown) for circulating the photoreceptor belt 110.

The transfer roller 124 presses against a pressing roller 125 with a constant pressure, and the toner image on the transfer roller 124 is transferred to the recording sheet 126 carried between the transfer roller 124 and the pressing roller 125. A charging station 135 for electrically initializing the photosensitive surface of the photoreceptor belt 110 by charging the photoreceptor belt is provided in the vicinity of the photoreceptor belt 110 between the first roller 121 and the second roller 122. Laser scanning units 130 for forming latent electrostatic images by irradiating laser beams onto the photoreceptor belt 110, and development devices 140 for developing the latent electrostatic images into toner images by applying a developer liquid of a predetermined color to the latent electrostatic images, are alternately provided in the section of the photoreceptor belt 110 between the second roller 122 and the third roller 123.

The toner image passes over the third roller 123 and is dried by a drying roller 171. The drying roller 171 absorbs the liquid carrier remaining on the photoreceptor belt 110 and the carrier is evaporated by a heat roller 172 in contact with the drying roller 171.

Referring to FIG. 2, a colored developer liquid 148 is contained in a case of the development device 140, and a development roller 143, and first and second squeegee rollers 146 and 147 are disposed in the moving direction of the photoreceptor belt 110 above the developer liquid 148. The development roller 143 applies the developer liquid 148 to the photosensitive surface of the photoreceptor belt 110. The developer liquid 148 is supplied between the development roller 143 and the photoreceptor belt 110 by a developer liquid supplier 145. A cleaning roller 144 installed under the development roller 143 cleans the surface of the development roller 143. The first and second squeegee rollers 146 and 147 remove excess developer liquid remaining after the latent electrostatic image is developed. The developer liquid sticking to the first and second squeegee rollers 146 and 147 is separated by blades 151*a* and 151*b* in contact with the surfaces of the first and second squeegee rollers 146 and 147.

Referring to FIGS. 3 and 4, the development roller 143 is spaced apart from the photoreceptor belt 110 by a predetermined distance and rotates in the same direction as the photoreceptor belt 110 travels, to apply the developer liquid 148 supplied therebetween to the photoreceptor belt 110. The developer liquid 148*a* sticking to the photoreceptor belt 110 forms a development region 115, which is the same width as the development roller 143 and is squeegeed by the first squeegee roller 146 rotating in the traveling direction of the photoreceptor belt 110. A thin-film like toner image 148*d* corresponding to the latent electrostatic image is formed on the development region 115 by the excess developer liquid due to the squeegeeing by the first squeegee roller 146. As the first squeegee roller 146 descends and then rotates opposite to the traveling direction of the photoreceptor belt 110, the developer liquid sticking to the first squeegee roller 146 is separate from the first squeegee roller 146 by the blade 151*a* in contact with the first squeegee roller 146 and drips down into the case 141.

Wrap-around developer liquid 148*c* is pushed to both edges 148*b* of the photoreceptor belt 110, outside the development region 115, when squeegeed by the first squeegee roller 146, and then removed by the second squeegee roller 147 in contact with the edges 148*b* of the photoreceptor belt 110. The second squeegee roller 147 rotates opposite to the traveling direction of the photoreceptor belt 110 to remove the wrap-around developer liquid 148*c* by contact with the photoreceptor belt 110. The wrap-around developer liquid 148*c* sticking to the second squeegee roller 147 is separated from the second squeegee roller 147 by the blade 151*b* in contact with the surface of the second squeegee roller 147.

The blades 151*a* and 151*b* are made of a soft elastomeric material but have a shorter life than other components of the development apparatus. When worn or damaged, blades 151*a* and 151*b* cannot serve their purpose but may damage the surface of the squeegee rollers 146 and 147. Thus, after the blades 151*a* and 151*b* are used for a certain period, they must be replaced with new ones.

However, since the blades 151*a* and 151*b* are coupled to brackets 152*a* and 152*b*, respectively, and the internal structures of the development devices 140 for accommodating the blades 151*a* and 151*b* and the brackets 152*a* and 152*b* are complex, it is very difficult and time consuming for a user to detach the blades 151*a* and 151*b*. Since it is not possible to replace only the blades in some cases, the whole development apparatus must be replaced, which is expensive.

SUMMARY OF THE INVENTION

To solve the above problem, it is an objective of the present invention to provide a development apparatus for a liquid electrophotographic printer which can effectively remove a developer liquid from the surface of a squeegee roller and have a cleaning device which can be used for a long time.

Accordingly, to achieve the above objective, there is provided a development apparatus for a liquid electrophotographic printer comprising:

a development roller for supplying a developer liquid to a photoreceptor belt on which a latent electrostatic image is formed;

a plurality of squeegee rollers for removing excess developer liquid sticking to the photoreceptor belt;

at least one cleaning device having a rotary body rotatably installed in proximity with at least one of the plurality of squeegee rollers, and a plurality of blades installed on the perimeter of the rotary body at a predetermined spacing in contact with the surfaces of the respective squeegee roller; and rotation means for selectively bringing one of the plurality of blades into contact with the surface of the respective squeegee roller.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
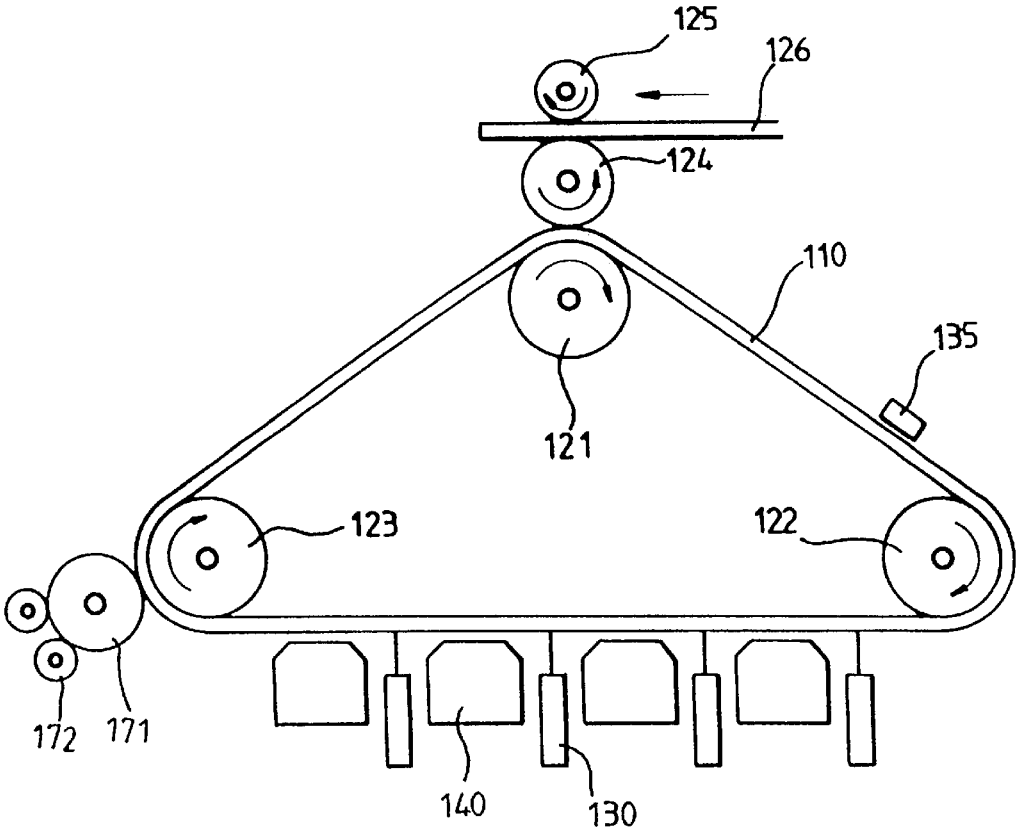
FIG. 1 (PRIOR ART)
FIG. 1 is a diagram of a general liquid electrophotographic printer.
Figure 2:
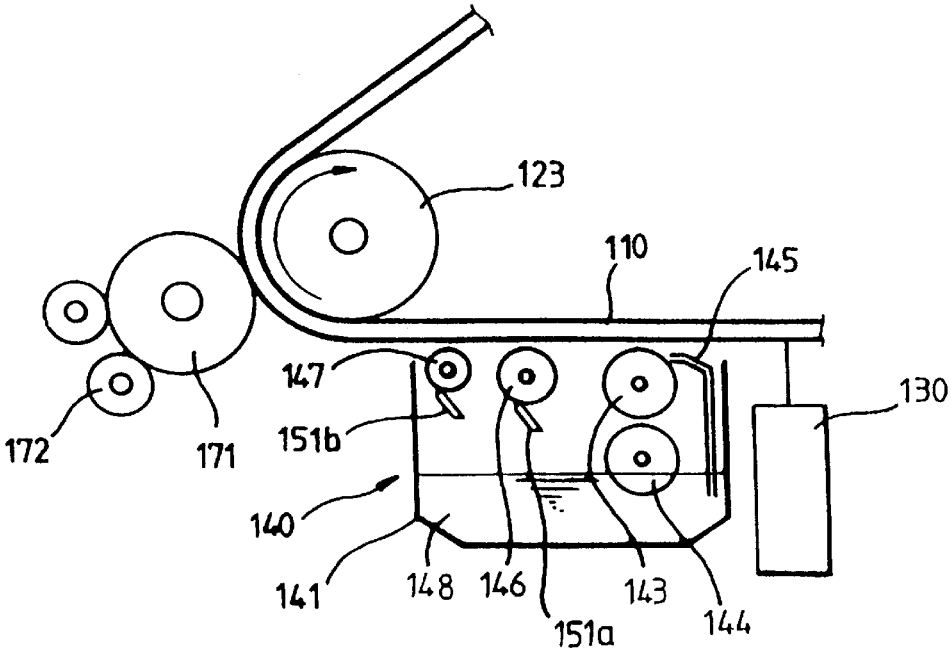
FIG. 2 (PRIOR ART)
FIG. 2 is a diagram of a conventional development apparatus shown in FIG. 1.
Figure 3:
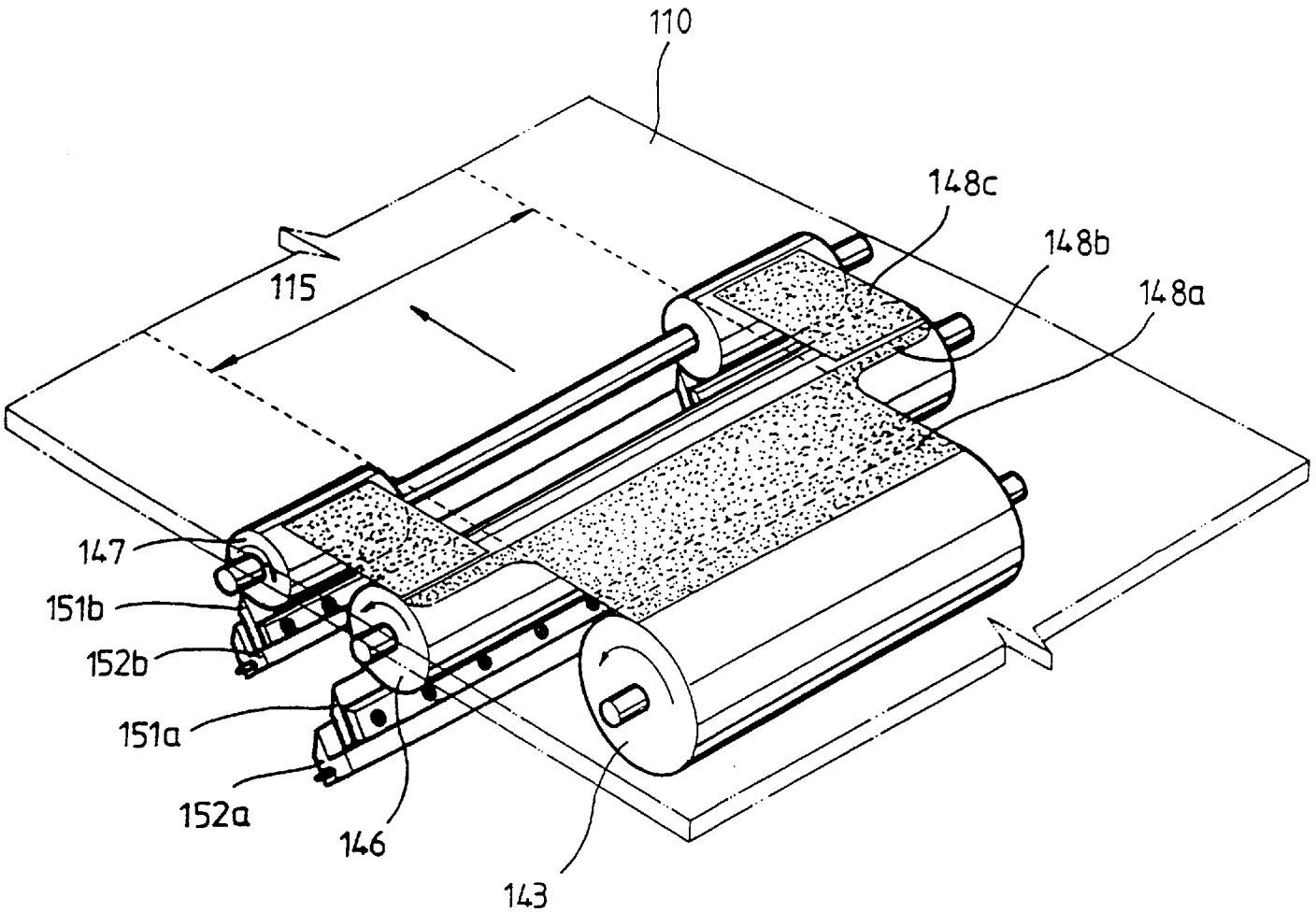
FIG. 3 (PRIOR ART)
FIG. 3 is a perspective view of important parts of the development apparatus shown in FIG. 2.
Figure 4:
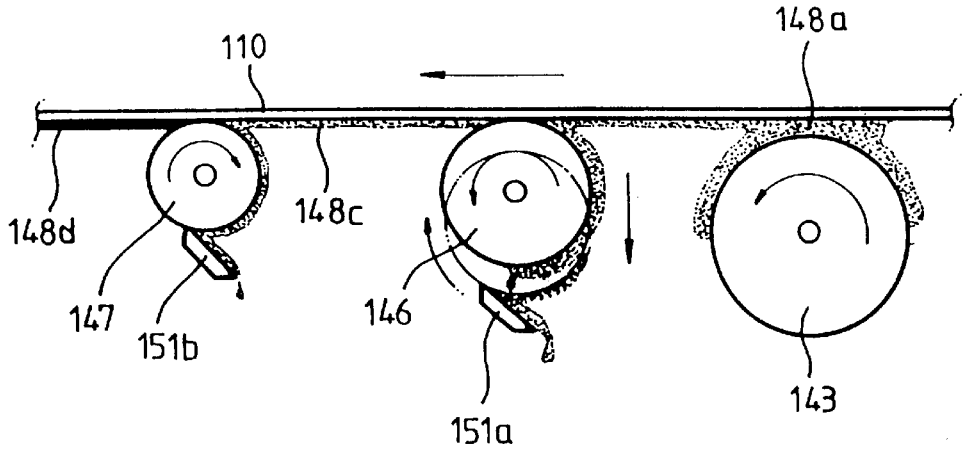
FIG. 4 is a side view of parts of a development apparatus for explaining a procedure for developing a latent electrostatic image formed on a photoreceptor belt in a general liquid electrophotographic printer by supplying a developer liquid.
Figure 5:
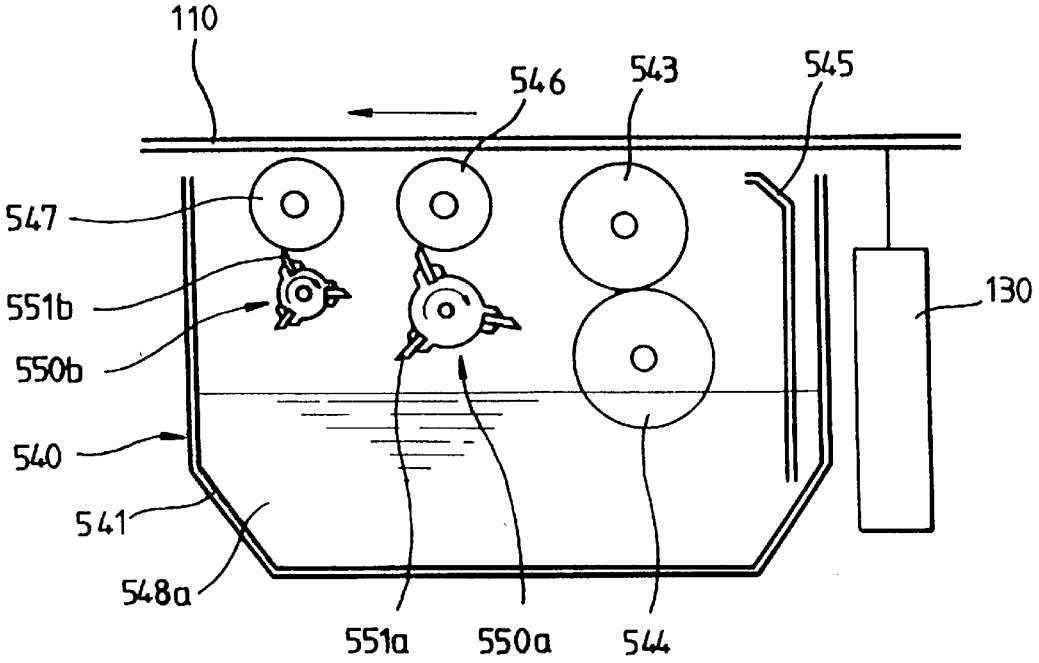
FIG. 5 is a schematic diagram of a development apparatus according to the present invention.

Referring to FIG. 5, a development apparatus 540 according to the present invention is installed in the proximity of the lower portion of a photoreceptor belt 110, and includes a development roller 543 for supplying a developer liquid 548*a* to the photoreceptor belt 110, and first and second squeegee rollers 546 and 547 for removing the excess developer liquid 548*a* by squeegeeing the photoreceptor belt 110. The developer liquid 548*a* containing a colored toner mixed in a liquid carrier is stored in a case 541 of the development apparatus 540. A cleaning roller 544 for cleaning the development roller 543 is positioned below the development roller 543. A developer liquid supplier 545, for supplying the developer liquid 548*a* between the development roller 543 and the photoreceptor belt 110, is positioned at one end of the development apparatus 540.

Cleaning devices 550*a* and 550*b* for removing the developer liquid sticking to the corresponding squeegee rollers 546 and 547 are installed below the squeegee rollers 546 and 547.

The respective cleaning devices 550*a* and 550*b* are constructed such that the blades 551*a* and 551*b* are installed at an equal spacing around rotary bodies 553*a* and 553*b*.

Figure 6:
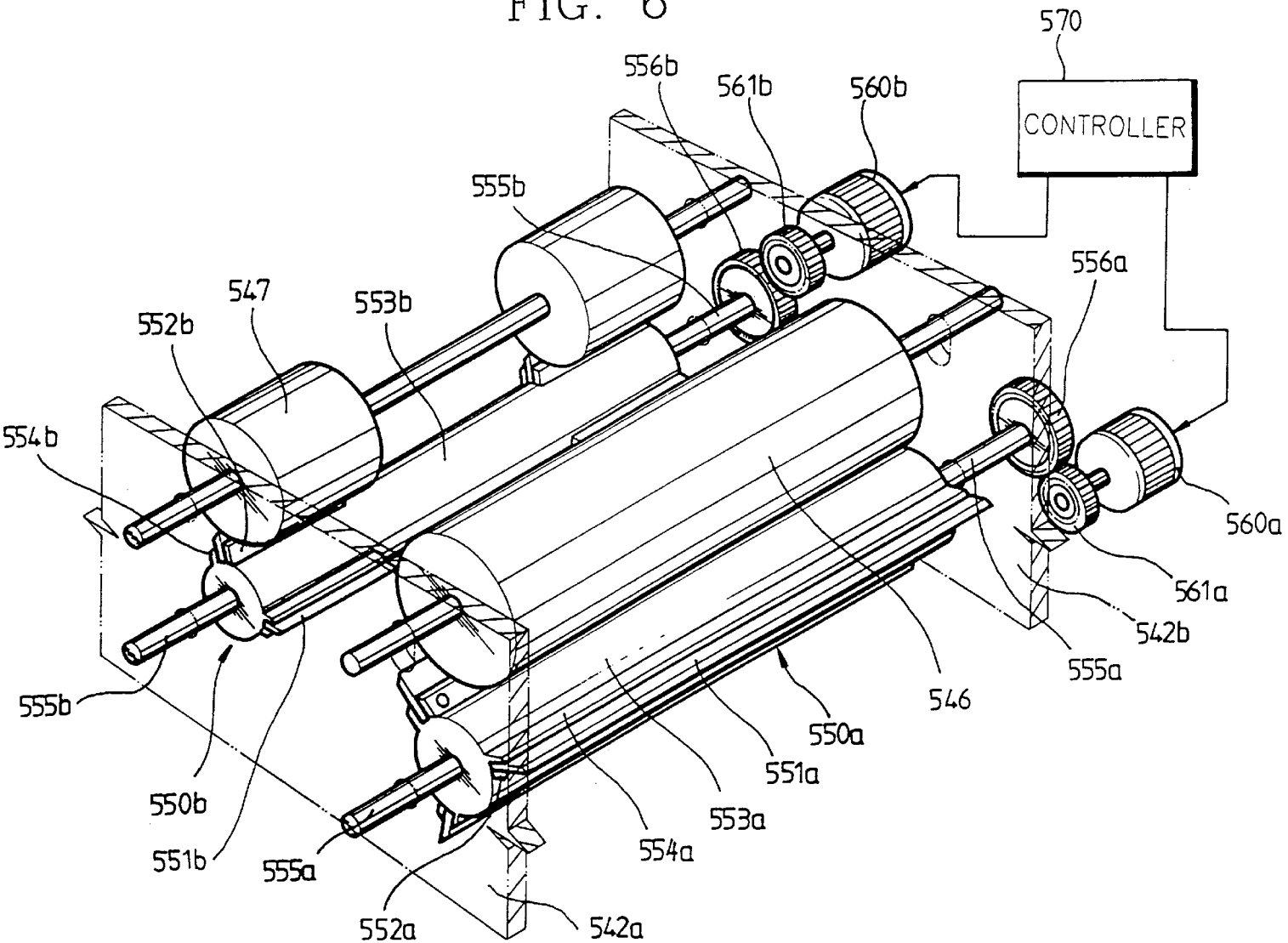
FIG. 6 is a perspective view of the development apparatus shown in FIG. 5.

Referring to FIG. 6, the first and second squeegee rollers 546 and 547 are rotatably supported by frames 542*a* and 542*b* of the development apparatus. The cleaning devices 550*a* and 550*b* which are respectively installed below the first and second squeegee rollers 546 and 547 include cylindrical rotary bodies 553*a* and 553*b* having rotation shafts 555*a* and 555*b* at both ends, and blades 551*a* and 551*b* disposed at an equal spacing around the outer surface of the rotary bodies 553*a* and 553*b*. The rotation shafts 555*a* and 555*b* are rotatably supported by the frames 542*a* and 542*b* of the development apparatus. Supporting ribs 554*a* and 554*b*, for supporting the blades 551*a* and 551*b*, and brackets 552*a* and 552*b* for closely joining the blades 551*a* and 551*b* to the supporting ribs 554*a* and 554*b*, are coupled to the outer surface of the rotary bodies 553*a* and 553*b*. Since the blades 551*a* and 551*b* contact the surfaces of the squeegee rollers 546 and 547, the blades 551*a* and 551*b* are made of a soft elastomeric material for preventing damage to the surfaces of the squeegee rollers 546 and 547.

Figure 7:
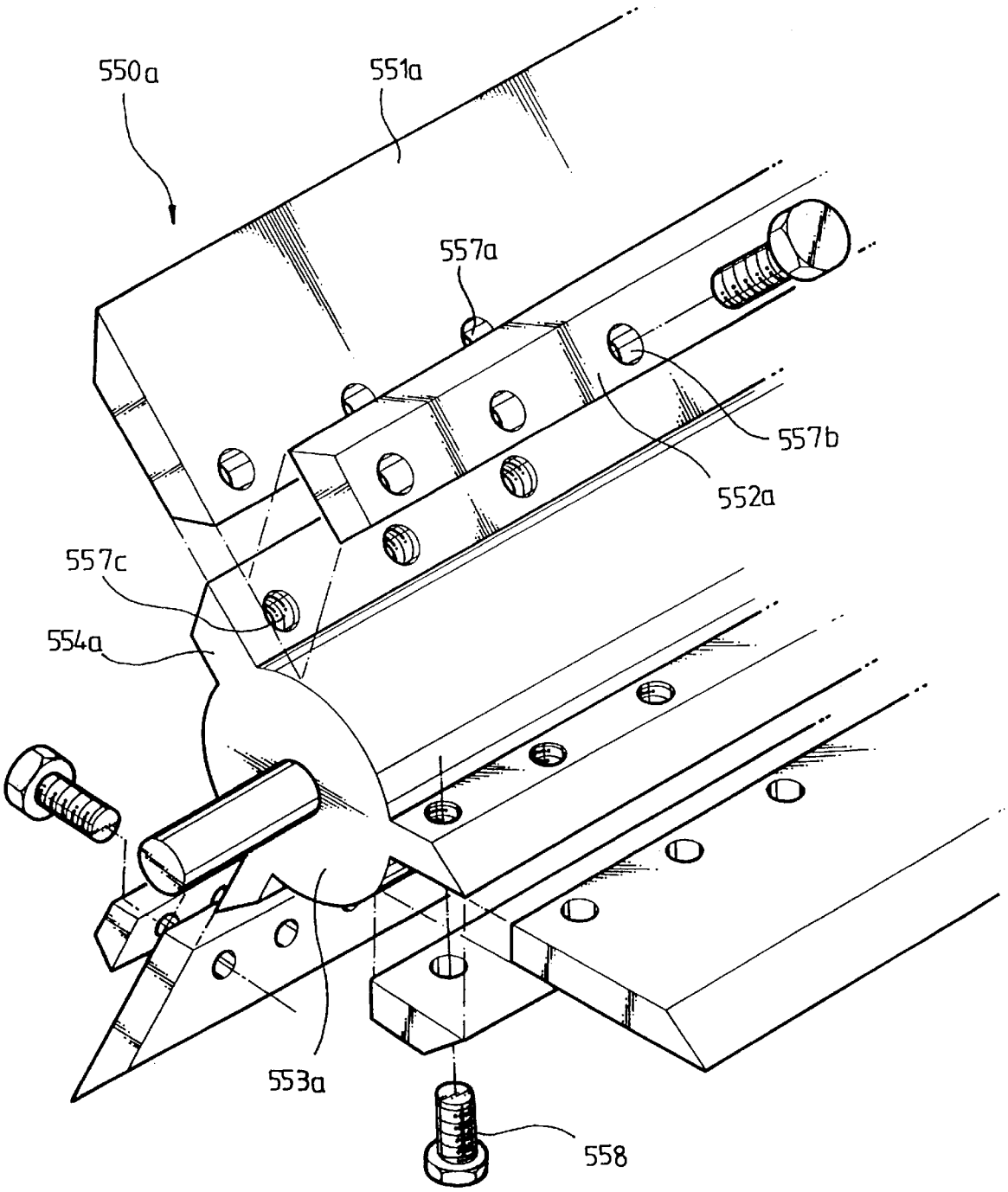
FIG. 7 is an exploded perspective view of a cleaning device shown in FIG. 6.

Referring to FIG. 7, a plurality of supporting ribs 554*a* protrude from the outer surface of the rotary body 553*a* of the cleaning device 550*a* corresponding to the first squeegee roller 546. The supporting ribs 554*a* are spaced equidistantly. The blade 551*a* is joined to the supporting rib 554*a* by the bracket 552*a*. A plurality of screw fastening holes 557*a*, 557*b* and 557*c* for accommodating screws 558 are formed in corresponding positions of the blade 551*a*, bracket 552*a* and supporting rib 554*a*.

When the plurality of blades 551*a* are used for an extensive period and become worn, they must be replaced with new ones.

As shown in FIG. 6, the cleaning devices 550*a* and 550*b* each have rotation means for selectively bringing one of the plurality of blades 551*a* and 551*b* of the respective rotary bodies 553*a* and 553*b* by rotating the rotary bodies 553*a* and 553*b* into contact with the respective squeegee rollers 546 and 547. The rotation means respectively include driving motors 560*a* and 560*b*, driving gears 561*a* and 561*b* coupled to the rotation shafts of the driving motors 560*a* and 560*b*, and driven gears 556*a* and 556*b* coupled to the rotation shafts 555*a* and 555*b* of the cleaning devices 550*a* and 550*b* and meshing with the respective driving gears 561*a* and 561*b*.

The driving motors 560*a* and 560*b* can be operated by a user's manipulation after a predetermined period. However, a controller 570 is preferably provided for automatically operating the cleaning devices 550*a* and 550*b* when the blades 551*a* and 551*b* must be replaced.

The controller 570 must operate the driving motors 560*a* and 560*b* when the blades 551*a* and 551*b* must be replaced. Thus, it is necessary to detect the exact time when the blades 551*a* and 551*b* are to be replaced.

The replacement time of blades is best determined by visually checking the wear of the blades. In this case, however, since the development apparatus must be dismantled by the user, this is substantially impossible. Also, the replacement time of blades can be determined by development quality exhibited on a recording sheet. However, the development quality may be degraded due to reasons other than defects of the blades. Furthermore, if the development quality is poor, since the replacement time of the blades many have already passed, the replacement time will be missed.

Therefore, it is preferable that the wear extent of the blades is gauged by the number of uses, that is, the number of developments performed by the development apparatus. In other words, the wear extent of the blades is calculated by trial and error by counting the development cycles of the development apparatus, and is set as a reference value in the controller for controlling the cleaning device. On the basis of the reference value, the controller controls the cleaning device so that the blades can be effectively replaced.

As described above, in the development apparatus for a liquid electrophotographic printer according to the present invention, a plurality of blades are provided for removing a developer liquid remaining on the surface of each of the squeegee rollers. Therefore, when one blade is worn, the worn blade can be replaced with a new one without dismantling the development apparatus, and thus the life of the development apparatus is prolonged, thereby saving maintenance costs.

What is claimed is:

1. A development apparatus for a liquid electrophotographic printer comprising:

a development roller for supplying a developer liquid to a photoreceptor belt on which a latent electrostatic image is formed;

a squeegee roller for removing excess developer liquid sticking to the photoreceptor belt;

a cleaning device having a rotary body rotatably installed in proximity to said squeegee roller, said cleaning device further including a plurality of blades installed on a perimeter of the rotary body at a predetermined spacing so that said plurality of blades can be individually brought into contact with a surface of said squeegee roller; and rotation means for selectively bringing one of said plurality of blades into contact with the surface of said squeegee roller.

2. The development apparatus according to claim 1, wherein said blades are detachably installed on the rotary body.

3. The development apparatus according to claim 1, wherein the rotation means comprises:

a driving motor having a driving shaft;

a driving gear coupled to the driving shaft; and a driven gear meshing with the driving gear;

wherein said rotary body has a rotational shaft, and wherein said driven gear is coupled to said rotational shaft.

4. The development apparatus according to claim 3, further comprising a controller for controlling when said rotation means brings a new blade into contact with the surface of said squeegee roller.

5. The development apparatus according to claim 4, wherein said controller operates the driving motor after detecting a predetermined number of development cycles performed by the development apparatus.

6. The development apparatus according to claim 1, further comprising:

a plurality of squeegee rollers for removing excess developer liquid sticking to the photoreceptor belt; and a plurality of cleaning devices corresponding to said plurality of squeegee rollers, each of said cleaning devices having a respective rotary body rotatably installed in proximity to a corresponding squeegee roller, and each of said cleaning devices further including a plurality of blades installed on a perimeter of the respective rotary body at a predetermined spacing so that said plurality of blades can be individually brought into contact with the corresponding squeegee roller; and wherein said rotation means controls the rotation of said rotary bodies.

* * * * *